US007575464B2

(12) United States Patent
Kobayashi et al.

(10) Patent No.: US 7,575,464 B2
(45) Date of Patent: Aug. 18, 2009

(54) CONNECTOR WITH CHANNEL-SHAPED CLEARANCE BETWEEN LOCK ARM AND PROJECTION TO PREVENT ENTRY OF WIRES

(75) Inventors: Yuka Kobayashi, Yokkaichi (JP); Tsutomu Tanaka, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/104,511

(22) Filed: Apr. 17, 2008

(65) Prior Publication Data

US 2008/0261437 A1 Oct. 23, 2008

(30) Foreign Application Priority Data

Apr. 20, 2007 (JP) ..... 2007-111135

(51) Int. Cl.
*H01R 13/627* (2006.01)

(52) U.S. Cl. ..... 439/358

(58) Field of Classification Search ..... 439/358, 439/357, 353, 351, 354
See application file for complete search history.

(56) References Cited

U.S. PATENT DOCUMENTS 6,129,593 A * 10/2000 Aoyama et al. ..... 439/701
6,325,656 B1 * 12/2001 Fukuda et al. ..... 439/358
6,435,896 B1 8/2002 Takatsuki
6,902,420 B2 * 6/2005 Muro et al. ..... 439/358

* cited by examiner

*Primary Examiner*—Phuong K Dinh
(74) *Attorney, Agent, or Firm*—Gerald E. Hespos; Anthony J. Casella

(57) ABSTRACT

A connector housing (20) is formed with a resiliently deformable lock arm (25) and ribs (36) are stand at opposite sides of the lock arm (25). The lock arm (25) resiliently locks a mating connector housing to lock the two connector housings in a connected state. Projections (35) project laterally from opposite lateral sides of the lock arm (25). Clearances (Q) are formed between the projections (35) and the ribs (36) by recessing the inner surfaces of the ribs (36). The clearances (Q) have channel shapes in rear view.

13 Claims, 5 Drawing Sheets

CONNECTOR WITH CHANNEL-SHAPED CLEARANCE BETWEEN LOCK ARM AND PROJECTION TO PREVENT ENTRY OF WIRES

BACKGROUND OF THE INVENTION

1. Field of the Invention

The invention relates to a connector.

2. Description of the Related Art

U.S. Pat. No. 6,435,896 discloses a connector with a housing formed with a resiliently deformable lock arm and ribs that project at opposite sides of the lock arm. The lock arm engages a mating housing when the housing and the mating housing are connected properly to lock the housings together. Projections project laterally from opposite sides of the lock arm, and escaping portions are formed at inner surfaces of projecting ends of the ribs for avoiding interference with the projections.

Small clearances are formed between the projecting ends of the projections and the escaping portions. The clearances are narrowed to prevent wires from entering the clearances getting jammed. However, upper ends of the clearances are open and wires lowered from above can enter the clearances.

The invention was developed in view of the above situation and an object thereof is to prevent a wire from getting jammed.

SUMMARY OF THE INVENTION

The invention relates to a connector with a housing. A resiliently deformable lock arm is formed on the housing and ribs are formed adjacent to the lock arm. The lock arm engages a mating housing to lock the two housings in a connected state. One or more projections project laterally from the lock arm and one or more clearances are formed between lateral sides of the projections and the respective ribs. The clearances have channel shapes in rear view. Thus, the clearances define a labyrinth or meandering shape that impedes entry and jamming of wires.

The projections preferably are formed on both lateral sides of the lock arm, and clearances between each projection and the corresponding rib preferably are channel shaped in the rear view.

Covers preferably are formed on the projecting ends of the ribs and overlap lateral ends of the projections while defining the clearances. The covers further impede entry of the wires into the clearances.

Inner surfaces of the covers preferably have slanted surfaces that incline out towards the projecting ends. The projections of the lock arm can contact the slanted surfaces to prevent outward displacement of the lock arm.

The clearances preferably are formed by recessing the inner surfaces of the ribs in the thickness direction. Thus, the width of the entire housing can be narrowed while a sufficient projecting amount of the projections is ensured.

Widthwise distances between the inner surfaces of the ribs at the base ends and the lateral ends of the projections preferably is much shorter than a clearance dimension between the slanted surfaces of the covers and lateral ends of the projections. Thus, inner surfaces of the ribs at the base ends can contact the lateral ends of the projections to suppress loose movements of the projections in the width direction.

A clearance between the side surfaces of the recesses and the lateral ends of the projections preferably is slightly larger than a clearance dimension a clearance dimension between the slanted surfaces of the covers and the lateral ends of the projections.

The lock arm preferably includes a beam that extends substantially in forward and backward directions and one or more supports that connect a lengthwise intermediate portion of the beam and the housing. The beam preferably is pivotally displaceable like a seesaw about the supports.

These and other features of the invention will become more apparent upon reading the following detailed description of preferred embodiments and accompanying drawings.

DETAILED DESCRIPTION OF THE PREFERRED EMBODIMENTS

A connector in accordance with the invention is identified by the numeral 10 in FIGS. 1 to 5. The connector 10 of this embodiment is a female connector and is provided with a housing 20 and female terminal fittings 60.

Figure 1:
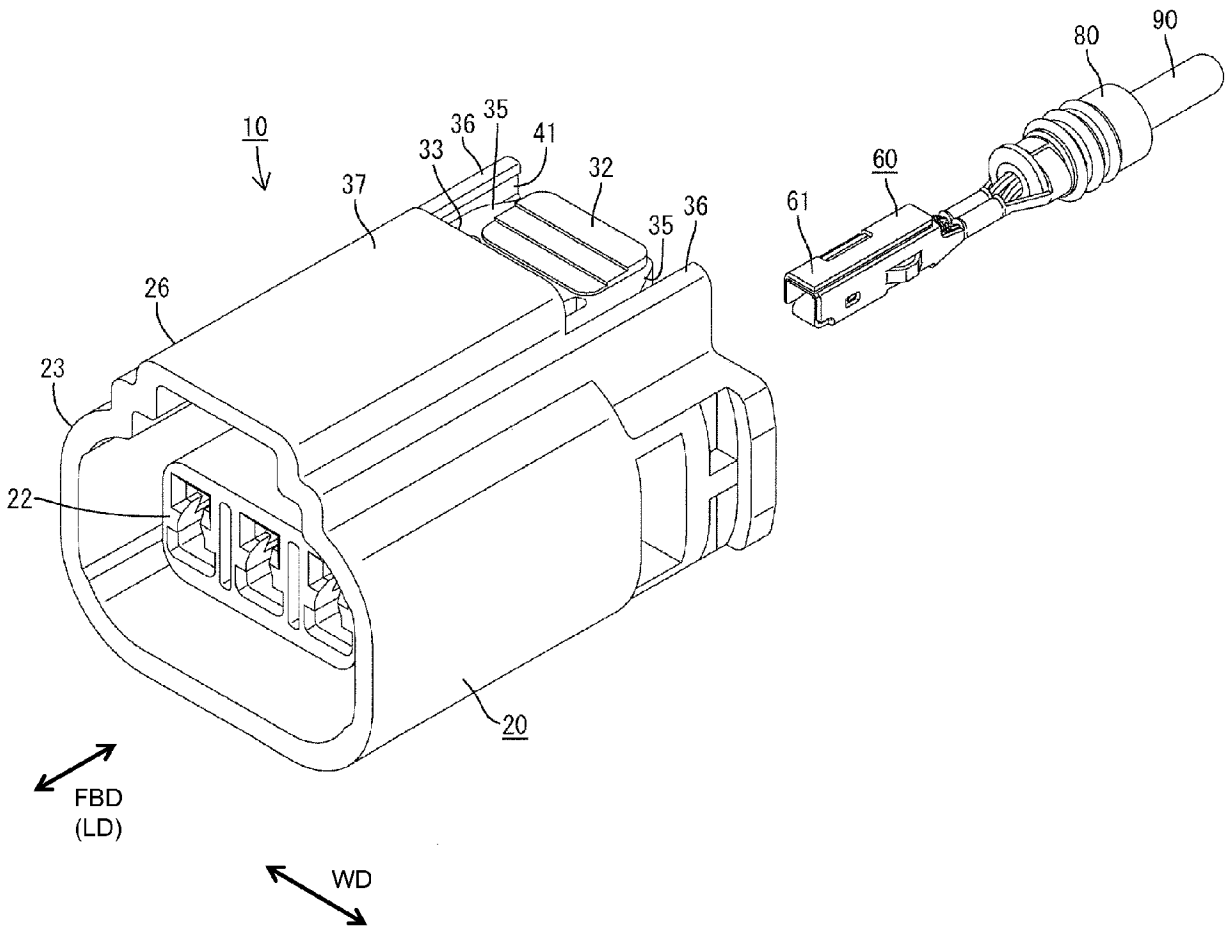
FIG. 1 is a perspective view of a connector according to one embodiment of the invention.

Each terminal fitting 60 is formed, for example, by bending, folding and/or embossing an electrically conductive metal plate and is to be connected with an end of a wire 90 together with a resilient plug 80, as shown in FIG. 1. The terminal fitting 60 has a substantially rectangular tubular main portion 61 for receiving a mating male terminal fitting (not shown) from the front.

Figure 4:
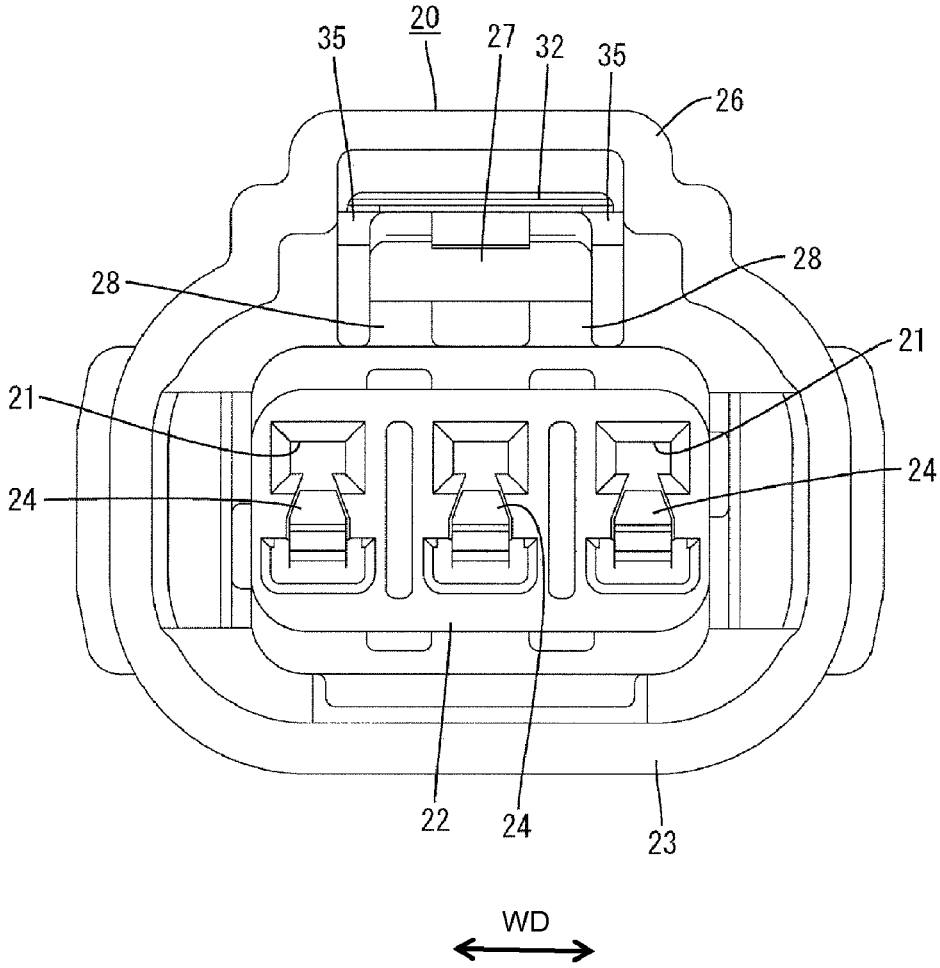
FIG. 4 is a front view of the connector housing.

The housing 20 is made e.g. of a synthetic resin and includes a terminal accommodating portion 22 formed with cavities 21 for accommodating the respective terminal fittings 60 and a substantially tubular portion 23 surrounds the terminal accommodating portion 22, as shown in FIG. 4. A receptacle (not shown) of a mating male connector is insertable between the terminal accommodating portion 22 and the tubular portion 23. Cavities 21 are arranged in a row in the width direction WD at one or more stages in the terminal accommodating portion 22, and a resiliently deformable lock 24 is provided on an inner wall of each cavity 21 for retaining the terminal fitting 60.

A resiliently deformable lock arm 25 is formed substantially in the widthwise center of the upper surface of the terminal accommodating portion 22. A bulge 26 extends in forward and backward directions FBD on the tubular portion 23 and at least partly surrounds the lock arm 25.

Figure 2:
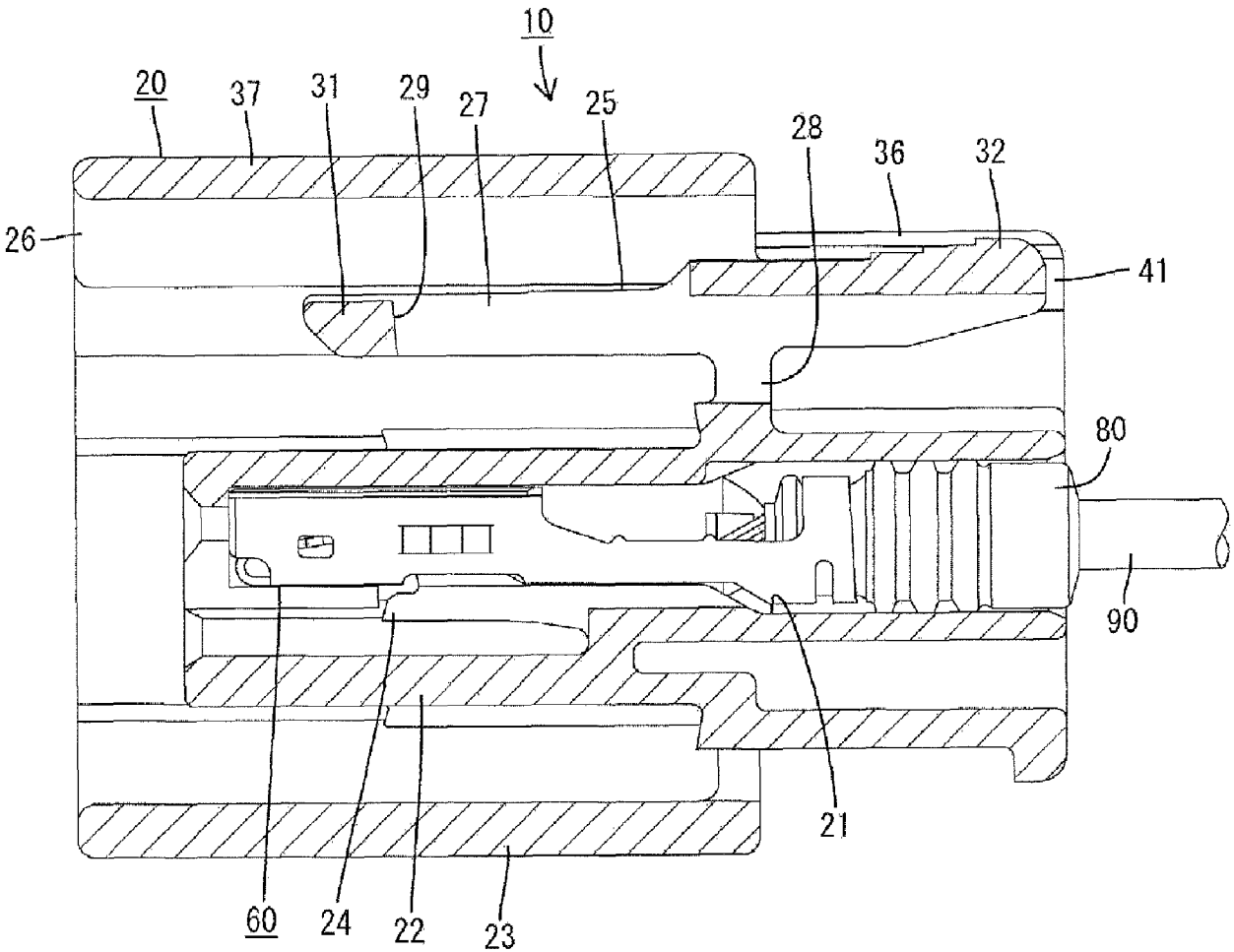
FIG. 2 is a side view in section of the connector.

As shown in FIG. 2, the lock arm 25 includes a beam 27 that extends substantially in forward and backward directions FBD. Left and right supports 28 connect the upper surface of the terminal accommodating portion 22 to a lower surface of the beam 27 at an intermediate portion of the beam 27 in the lengthwise direction LD. Thus, the beam 27 is pivotally and resiliently displaceable like a seesaw about the supports 28. A lock groove 29 extends along the beam 27 in forward and backward directions FBD from a position rearward of the leading end of the beam 27 and a locking main body 31 is formed at the leading end of the beam 27 forward of the lock groove 29. A mating lock projection is fit into the lock groove 29 and engages the locking main body 31 when the housing 20 is connected properly with a mating male connector for locking the two housings in a connected state.

An operable portion 32 is formed at the rear end of the beam 27 and is used for unlocking at the time of separating the two housings. A part of the lock arm 25 except the operable portion 32 is surrounded and covered by the bulge 26. However, the operable portion 32 is exposed through a cutout recess 33 at the rear end of the bulge 26.

Figure 5:
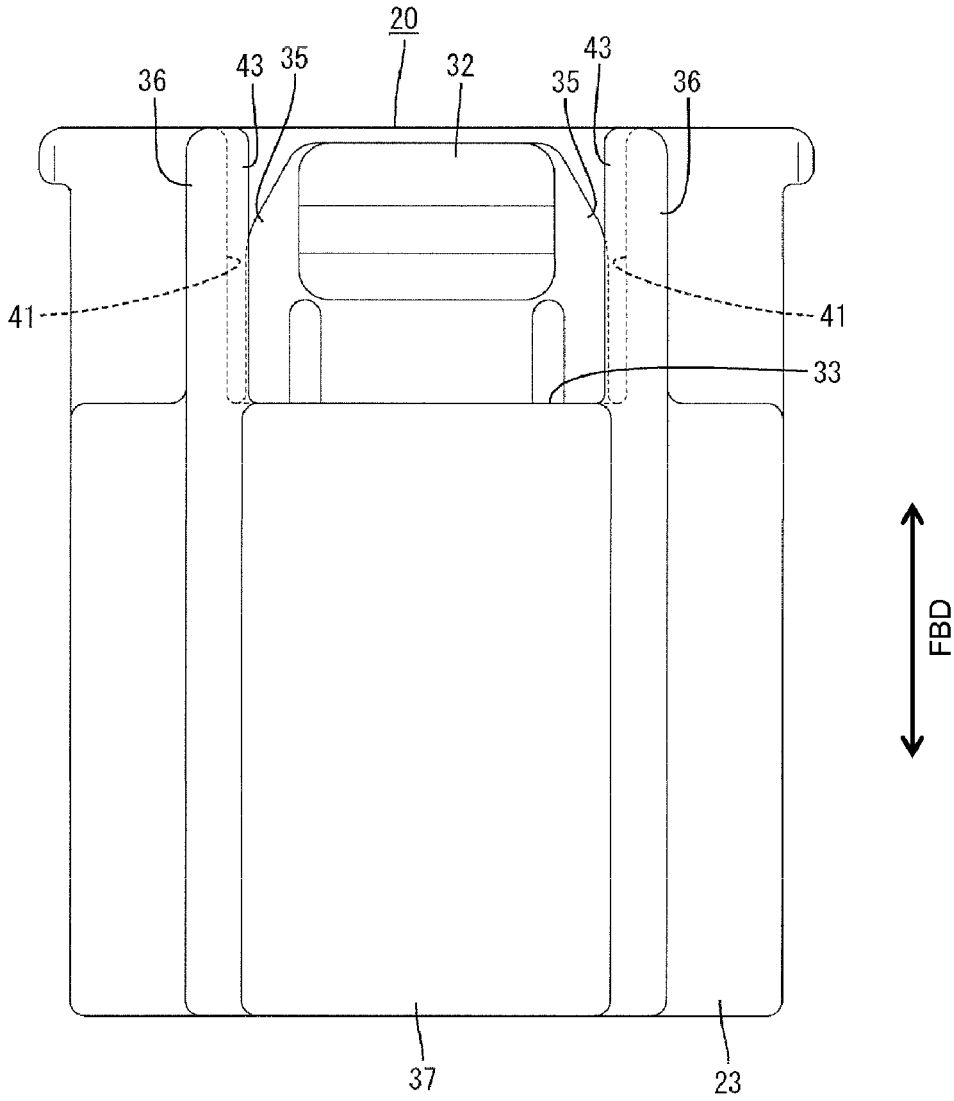
FIG. 5 is a plan view of the connector housing.

As shown in FIG. 5, left and right projections 35 are formed at the opposite lateral edges of the rear end of the beam 27 and project laterally out in the width direction WD. The projections 35 are narrow rectangular strips that extend forward after projecting towards the opposite lateral sides, and the extending ends thereof are connected unitarily with the inner wall of the bulge 26. The projections 35 function to give suitable rigidity to the entire lock arm 25 by being formed unitary to the tubular portion 23.

Left and right ribs 36 extend in forward and backward directions FBD from the rear end of the bulge 26 and are spaced apart from the opposite lateral edges of the beam 27. The ribs 36 are substantially vertical walls standing upward from the inwardly arcuate end edges of the tubular portion 23. The bulge 26 also is formed with a ceiling 37 that connects upper ends of the ribs 36 via steps at positions forward of the cutout recess 33. The ceiling 37 covers substantially all of the lock arm 25 from above except the operable portion 32.

Figure 3:
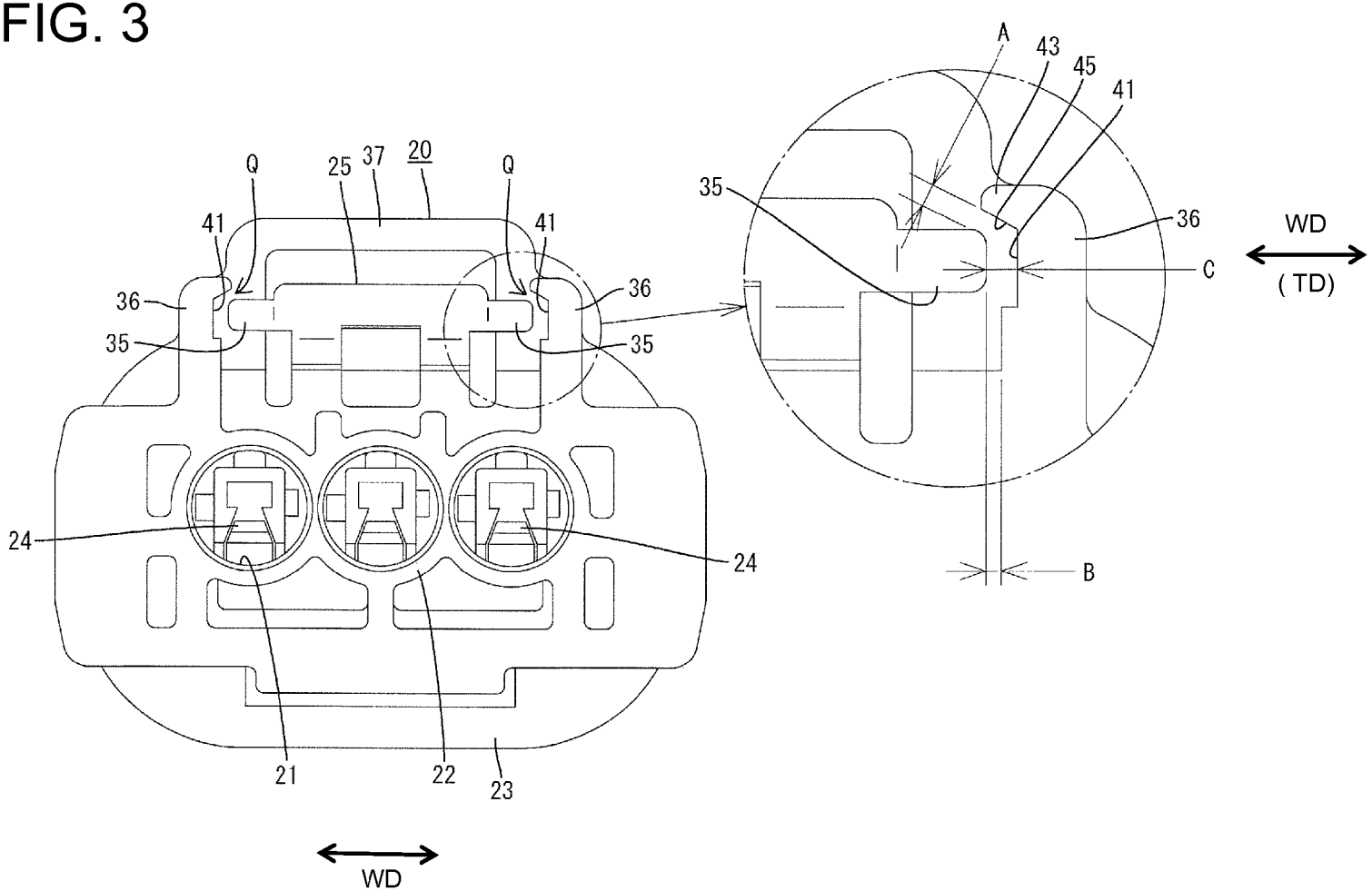
FIG. 3 is a rear view of a connector housing.

As shown in FIG. 3, small clearances Q are defined between the projections 35 and the ribs 36 and are channel-shaped or crank-shaped in rear view. More specifically, each clearance Q is formed between a substantially U-shaped recess 41 in the inner surface of the corresponding rib 36 and a lateral end of the corresponding projection 35. The thickness of the rib 36 is reduced by the recess 41, but the shape of the projection 35 is not changed. The outer surfaces of the ribs 36 project substantially vertically from the base ends thereof to the leading ends thereof, and the spacing between the outer surfaces of the ribs 36 is substantially constant.

Covers 43 project in at the upper ends of the ribs 36 to define upper parts of the recesses 41. Inner ends of the covers 43 overlap with the lateral ends of the projections 35 in the width direction WD to cover at least parts of the lateral ends of the projecting portions 35 from above. Slanted surfaces 45 face down on the lower surfaces of the covers 43 and define one of the inner surfaces of the recesses 41. The slanted surfaces 45 inclined up and out towards their projecting ends. Thus, the lateral end portions of the projections 35 can contact the slanted surfaces 45 to limit upward displacement of the lock arm 25.

The clearances Q between the slanted surfaces 45 of the covers 43 and the lateral edges of the projections 35 extend obliquely to be opened at inner upper sides. A clearance dimension A is set sufficiently smaller than the diameter of the wire 90 that might enter these clearances Q. A horizontal or widthwise distance B between the inner surfaces of the ribs 36 at the base ends and the lateral ends of the projections 35 is much shorter than (preferably less than about half of) the clearance dimension A between the slanted surfaces 45 of the covers 43 and the lateral ends of the projections 35. Thus, the inner surfaces of the ribs 36 at the base ends can contact the lateral ends of the projections 35 to suppress loose movements of the projections 35 in the width direction WD, thereby preventing shaking movements of the lock arm 25, when the beam 27 makes a pivotal displacement. A clearance dimension C between the vertical side surfaces of the recesses 41 and the lateral end surfaces of the projections 35 is slightly larger than the clearance dimension A between the slanted surfaces 45 of the covers 43 and the lateral ends of the projections 35. Thus, a projecting amount of the projections 35 can be increased within the range of the clearances corresponding to the dimension C.

The connector 10 is assembled by inserting the terminal fittings 60 into the respective cavities 21 of the housing 20. The housing 20 and the mating housing are connected in this state, and the two housings are locked in their connected state by the lock arm 25. In the process of connecting the two housings, the lock arm 25 interferes with the mating lock projection and pivots like a seesaw. As a result, the lateral ends of the projections 35 displace down towards the base ends of the ribs 36 along the inner surfaces of the ribs 36.

The operable portion 32 of the lock arm 25 can be pressed down to pivot the lock arm 25 in an unlocking direction so that the two housings can be separated for maintenance or the like. During this time, the lateral ends of the projections 35 are displaced towards the base ends of the ribs 36 along the inner surfaces of the ribs 36.

There is a concern that the wires 90 will enter the clearances Q between the lateral ends of the projections 35 of the lock arm 25 and the ribs 36 through the cutout recesses 33. However, the clearances Q between the lateral ends of the projections 35 and the ribs 36 define a labyrinth or meandering shape resembling a channel in rear view. The entrances of the clearances Q open obliquely towards the inner upper sides. Thus, the wires are likely to contact the upper surfaces of the covers 43 and are not likely to enter the clearances Q. Any wire 90 that might partly enter the clearance Q is not likely to advance to a position below the lower surface of the operable portion 32 because the clearance Q defining an entrance path for the wire 90 is bent to have the channel shape. As a result, the wire 90 reliably is prevented from getting jammed.

The covers 43 are at the projecting ends of the ribs 36 and are likely to interfere with wires 90 before the wires 90 can enter the clearances Q.

The clearances Q are formed by recessing inner surfaces of the ribs 36 in the thickness direction TD. Thus, the width of the housing 20 can be narrowed while a sufficient projecting amount of the projections 35 is ensured.

The invention is not limited to the above described and illustrated embodiments. For example, the following embodiments are also embraced by the technical scope of the present invention as defined by the claims.

The covers may not be formed at the upper ends of the ribs, and the ribs may not have parts overlapping with the lateral end portions of the projecting portions in the projecting direction.

The clearances may be formed by bending the entire ribs into channel to define meandering shapes in rear view.

The lock arm may be cantilevered rearwardly from a support at the front end of the housing.

The present invention is also applicable to male connectors.

What is claimed is:

1. A connector, comprising:

a housing;

a resiliently deformable lock arm formed on the housing, at least one projection projecting laterally from at least one lateral side of the lock arm; and at least one rib projecting on the housing at a position substantially adjacent to the lock arm, the rib being configured to define at least one clearance between a lateral end of the projection and the respective rib, the rib having a first thick portion adjacent the housing, a thin portion adjacent the first thick portion and opposed to the projection of the lock arm and a second thick portion adjacent the thin portion and spaced farther from the housing than the projection so that the clearance between the lateral end of the projection and the rib is configured to define a channel shape in rear view, the second thick portion having a slanted surface adjacent the thick portion and facing toward the projection for limiting outward displacement of the lock arm, a widthwise distance between a base end of an inner surface of the rib facing the lock arm and a lateral end of the projection being less than a clearance between the slanted surface of the second thick portion and the lateral end of the projection so that the inner surface at the base end of the rib contacts the lateral end of the projection to suppress loose lateral movements of the lock arm when the lock arm is deformed resiliently.

2. The connector of claim 1, wherein the second thick portion defines a cover substantially at a projecting end of the rib and overlapping at least a lateral end of the projection while defining the clearance.

3. The connector of claim 1, wherein the lock arm includes a beam extending substantially in forward and backward directions and at least one lateral support connecting the housing to a lengthwise intermediate portion of the beam.

4. The connector of claim 3, wherein the beam is pivotally displaceable like a seesaw with the support as a pivot.

5. A connector, comprising:

a housing;

a resiliently deformable lock arm formed on the housing, at least one projection projecting laterally from at least one lateral side of the lock arm; and at least one cover being formed substantially at a projecting end of the rib and overlapping at least a lateral end of the projection while defining a clearance, the cover having a slanted surface facing toward the projection for limiting outward displacement of the lock arm, wherein the clearance is formed by a recess in a surface of the rib facing the lock arm.

6. The connector of claim 5, wherein a clearance dimension between a side surface of the recess and the lateral end of the projection is slightly larger than a clearance dimension between the slanted surface of the cover and the lateral end of the projection.

7. A connector, comprising:

a housing;

a resiliently deformable lock arm formed on the housing, projections projecting laterally from opposite lateral sides of the lock arm; and ribs projecting on the housing at positions substantially laterally adjacent the lock arm, the ribs being configured to define clearances between lateral ends of the projections and the respective rib, each of the ribs having a first thick portion adjacent the housing, a thin portion adjacent the first thick portion and opposed to one of the projections of the lock arm and a second thick portion adjacent the thin portion and disposed so that the respective second thick portions of the ribs are farther from the housing than a distance between the projections of the lock arm and the housing so that the clearances are defined by recesses in surfaces of the respective ribs facing the lock arm and so that the ribs are configured to define a channel shape in rear view.

8. The connector of claim 7, wherein the second thick portions of the ribs define covers substantially at projecting ends of the ribs and overlapping lateral ends of the projections while defining the clearance.

9. The connector of claim 7, wherein each of the second thick portions has a slanted surface facing towards the respective projection for limiting outward displacement of the lock arm.

10. The connector of claim 9, wherein widthwise distances between base ends of an inner surfaces of the ribs facing the lock arm and a lateral end of the respective projection is less than clearances between the slanted surfaces of the covers and the lateral end of the respective projection, so that the inner surfaces at the base ends of the ribs contact the lateral ends of the projections to suppress loose lateral movements of the projection.

11. The connector of claim 7, wherein clearance dimensions between side surfaces of the recess and the lateral end of the projection are slightly larger than clearance dimensions between the slanted surfaces of the covers and the lateral end of the respective projection.

12. The connector of claim 7, wherein the housing has opposite front and rear ends, a bulge joining the ribs at positions adjacent the front end of the housing, extending ends of the projections of the lock arm being connected with an inner surface of the bulge.

13. A connector, comprising:

a housing having opposite front and rear ends;

a resiliently deformable lock arm formed on the housing, the lock arm having a rear end in proximity to the rear end of the housing and a front end opposite the rear end, projections projecting laterally from opposite lateral sides of the lock arm;

ribs projecting on the housing at positions substantially laterally adjacent the lock arm, the ribs being configured to define clearances between lateral ends of the projections and the respective rib, each of the ribs having a first thick portion adjacent the housing, a thin portion adjacent the first thick portion and opposed to one of the projections of the lock arm and a second thick portion adjacent the thin portion and disposed so that the respective second thick portions of the ribs are farther from the housing than a distance between the housing and the projections of the lock arm; and a bulge connecting the ribs at positions adjacent the front end of the housing and covering the front end of the lock arm, a portion of an extending end of each projection being connected with an inner surface of the bulge.

* * * * *